US006182761B1

(12) United States Patent
Bednar

(10) Patent No.: US 6,182,761 B1
(45) Date of Patent: Feb. 6, 2001

(54) FLOWLINE EXTENDABLE PIGGING VALVE ASSEMBLY

(75) Inventor: John M. Bednar, Kingwood, TX (US)

(73) Assignee: ExxonMobil Upstream Research Company, Houston, TX (US)

( * ) Notice: Under 35 U.S.C. 154(b), the term of this patent shall be extended for 0 days.

(21) Appl. No.: 08/969,131

(22) Filed: Nov. 12, 1997

(51) Int. Cl.[7] ..... E21B 43/013; E21B 43/017
(52) U.S. Cl. ..... 166/339; 166/347; 166/366
(58) Field of Search ..... 166/344, 347, 166/366, 335, 339; 15/104.062; 137/242, 268

(56) References Cited

U.S. PATENT DOCUMENTS 3,444,927 * 5/1969 Childers et al. ..... 166/351
3,473,605 * 10/1969 Thuse et al. ..... 166/344
4,367,980 * 1/1983 Ames et al. ..... 405/169
4,528,041 * 7/1985 Rickey et al. ..... 134/8
4,574,830 3/1986 Rickey et al. ..... 137/242
4,848,475 7/1989 Dean et al. ..... 166/357
5,025,865 6/1991 Caldwell et al. ..... 166/366
5,433,273 7/1995 Blandford ..... 166/344
5,435,338 * 7/1995 Da Silva et al. ..... 137/242
5,437,302 * 8/1995 Da Silva et al. ..... 137/242
5,842,816 * 12/1998 Cunningham ..... 405/170

* cited by examiner

*Primary Examiner*—Hoang Dang

(57) ABSTRACT

An apparatus and a method for extending subsea hydrocarbon flowlines from an initial installation on a template/manifold system to later drilled subsea wells. The extension utilizes a pigging valve assembly which completes a flow path to allow for line cleaning or pigging and is modified by adding a curved flowline connector adaptor to extend the subsea flowlines. The apparatus and method minimizes the amount of equipment that must be pre-installed to provide such flexibility, thus facilitating the ability to defer incremental development decisions.

32 Claims, 3 Drawing Sheets

FLOWLINE EXTENDABLE PIGGING VALVE ASSEMBLY

SPECIFICATION

1. Field of the Invention

This invention relates to an apparatus and method for extending offshore hydrocarbon flowlines and, more particularly, to extending hydrocarbon flowlines from a template/manifold system at a first subsea well site to a second well site using a flowline pigging assembly.

2. Description of the Prior Art

In the 1970's, the petroleum industry began to produce hydrocarbons from offshore subsea wells. Over the past three decades, many different configurations of subsea production system components have been generated to help develop these offshore hydrocarbon reserves. Depending upon the number of wells required by a given production plan, the system configurations range from a single satellite subsea well producing to a host platform, to large multi-well subsea template/manifold systems producing to a host platform or a large floating production unit.

In subsea template/manifold systems, wells are drilled from one single structure, and hydrocarbons are collected in a single manifold attached to the template for delivery to a production platform or other surface production unit. Various forms of templates have been used to integrate production of various subsea producing wells into a single area and to more easily collect the production in a single manifold. The main advantage of the template/manifold systems is the reduction in the number of remote interface connections between the wells and the manifold.

More recently, subsea clustered configurations have come into use, featuring a central manifold surrounded by a number of subsea satellite wells. See, for example, U.S. Pat. Nos. 4,848,475 and 5,025,865.

Where marginal fields are located in deep water, operators will often choose to initially place only a few subsea wells in specific locations to evaluate producability before installing a high cost production facility. Further, operators may wish to incrementally add wells such that the reservoir and production data from each successive well may be used to better assess the risk of subsequent development efforts. Accordingly, a method of extending subsea flowlines from an initial template to later drilled wells at a second template site would be desirable if it could minimize the investment required in the initial installation to accommodate such future expansion.

Whichever type of subsea production system is used, a need exists to provide a method to clean the hydrocarbon flowlines. In hydrocarbon production it is common to remove deposits or debris from flowlines by pumping a "pig" through the flowline. The pig scrapes or dislodges deposits from the interior of the flowlines, and those deposits are carried out of the flowlines by the same fluids that propel the pig. Pigging is used as part of an overall corrosion control program to remove deposits and sweep out water that may collect in the low spots of flowlines. Pigging may also be used to displace resident fluids in the flowlines as may be required by operational procedures. As hardware associated with pigging is a necessary part of the initial investment required with installation of the subsea system and associated flowlines, it would be desirable to use this pigging hardware also for future expansion of the subsea flowlines.

SUMMARY OF THE INVENTION

The present invention is a pigging valve assembly for a template/manifold system that provides a flow path between multiple subsea flowlines to circulate pigs through the flowlines for cleaning and which can be modified to provide connections for extending flowlines to later developed wells that are remote from the initial template/manifold. The present invention also provides a method of extending flowlines using a pigging valve assembly.

The assembly of the present invention provides a flow path between subsea flowlines that terminate at subsea template/manifold systems. A curved or "U" shaped piping section of the assembly connects various production headers that are in turn connected to flowlines. The curved piping section is bent at a radius sufficient to allow a pig to pass. The assembly also includes pigging valves located between the curved section and the production headers to isolate individual flowlines or allow flow and pig passage.

In its simplest form, the invention connects two subsea flowlines. When the flowlines need to be cleaned, the pigging valve on the subsea termination point of each flowline is opened. A pig is launched from a surface end of one flowline. The pig flows down the flowline, through the subsea manifold, and passes the open pigging valve. The pig then turns in the curved piping section, flows through the open pigging valve on the second flowline, and returns to the surface through the second flowline where it can be retrieved.

The present invention also allows flowlines to be extended with minimal impact on the template/manifold system. Extension is made by first retrieving the pigging valve assembly to the surface and removing the curved piping section. Flowline connector adaptors and a porch support module are added to the assembly replacing the curved piping section. Flowline connector adaptors are connected on one end to pigging valves while the opposite end provides a connection point for extending the flowline. The flowline connector adaptor is curved such that it will allow a pig to pass through it and into a new flowline. The modified pigging valve assembly with the porch support module is lowered onto the subsea template/manifold. A new section of flowline can be attached to the flowline connector adaptor to extend the original flowline to a second template/manifold at the new well site.

BRIEF DESCRIPTION OF THE DRAWINGS

A better understanding of the invention can be obtained when the detailed description set forth below is reviewed in conjunction with the accompanying drawings, in which.

DETAILED DESCRIPTION OF PREFERRED EMBODIMENT

Figure 1:
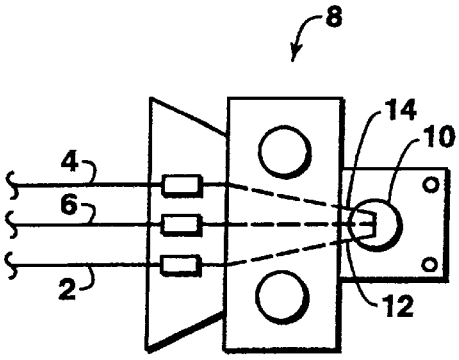
FIG. 1 is a schematic of a subsea template/manifold system including an embodiment of a pigging valve assembly in accord with the present invention.

As shown in FIG. 1, the present invention is a flowline extendable pigging valve assembly 10 that can be installed on a subsea template/manifold assembly 8 to provide a flow path between multiple subsea flowlines 2, 4, and 6 for circulating pigs for cleaning or displacement of resident fluids and debris. Extendable pigging valve assembly 10 is installed on a subsea template/manifold assembly 8 that handles hydrocarbon production from one or more subsea wells. Template/manifold assembly 8 is discussed in more detail in copending patent application Ser. No. 08/968,637, filed Nov. 12, 1997, and entitled "Extendable Semi-Clustered Subsea Development System", which application is hereby incorporated by reference and made a part of this patent application.

When cleaning of flowlines 2 or 4 is desired, a pig can be launched from one end of flowline 2 at a surface facility (not shown). The pig travels inside flowline 2 until it reaches the template/manifold system. At the template/manifold system, the pig moves from flowline 2 into production header 12 and on into the extendable pigging valve assembly 10 where it is redirected into production header 14. From production header 14, the pig flows back to the surface facility through flowline 4.

Figure 2:
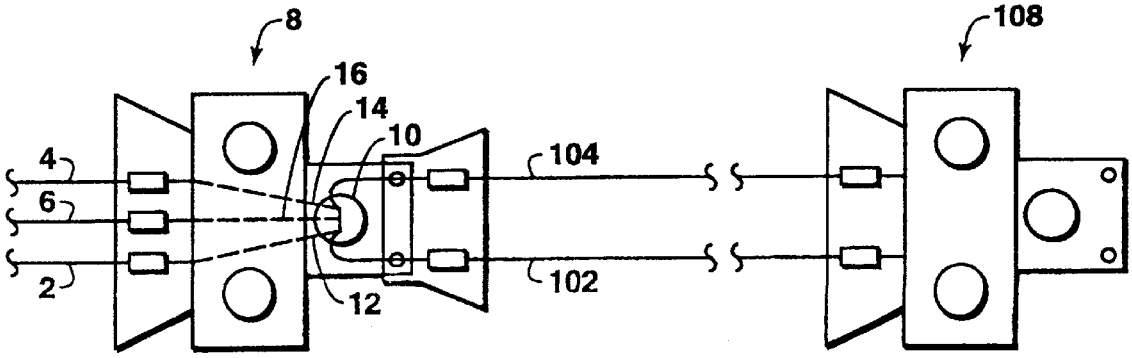
FIG. 2 is a schematic of the subsea template/manifold system of FIG. 1 in which the embodiment of the pigging valve assembly has been modified in accord with the present invention to extend flowlines to a second template/manifold system.

As shown in FIG. 2, the present invention can be modified to provide connections for flowline extensions 102 and 104 that extend to wells developed at a second template/manifold system 108. As modified, hydrocarbons from the second site can be transported through flowline extensions 102 and 104 into the modified assembly 10 where the hydrocarbons are redirected through production headers 12, 14, and 16 into flowlines 2, 4, and 6 for return to the surface facility.

Figure 3:
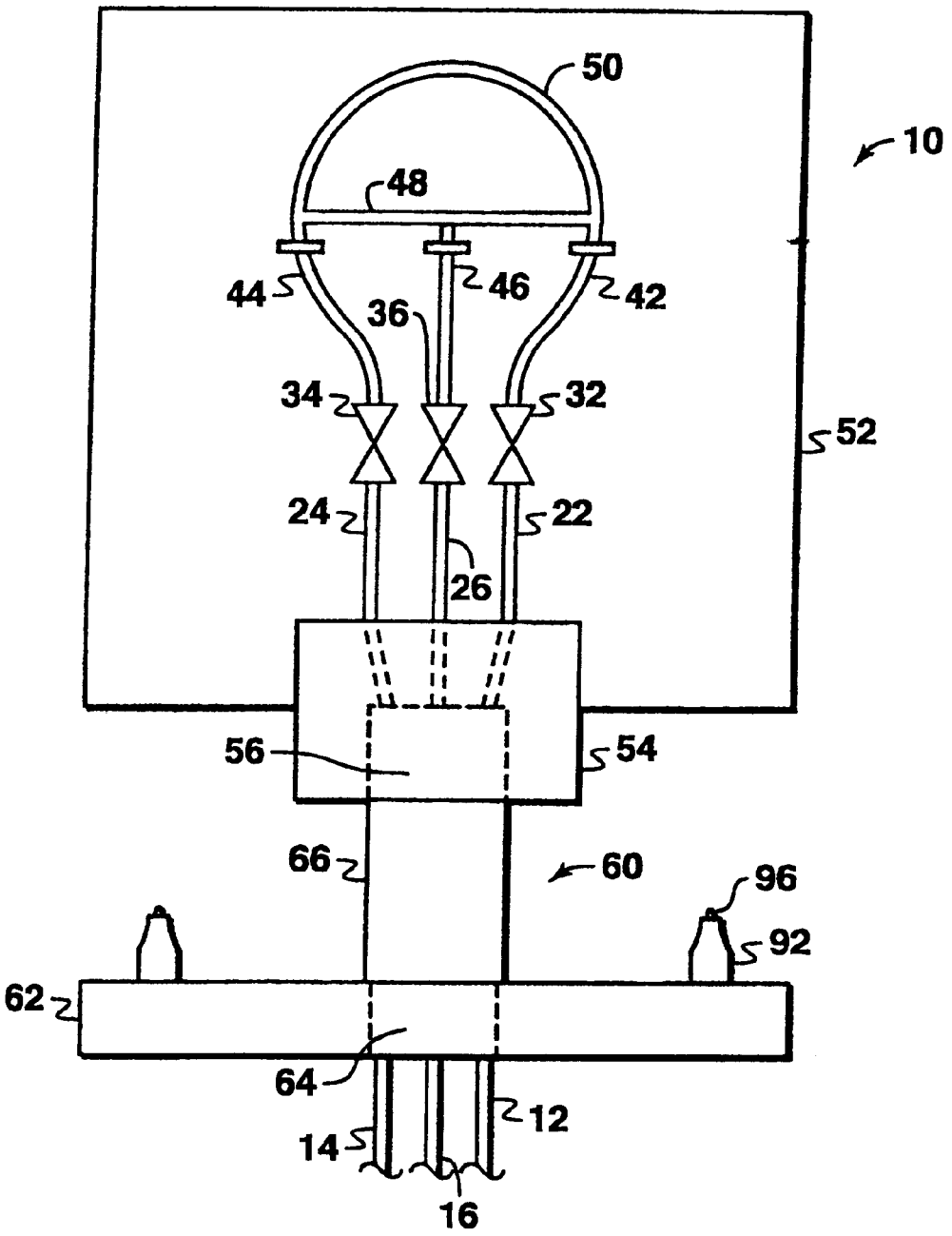
FIG. 3 is a frontal view of a preferred embodiment of the pigging valve assembly as originally installed on a subsea template/manifold system.

As shown in FIG. 3, in normal operation hydrocarbon production from a subsea well is directed into production headers 12, 14, and 16 of the subsea template/manifold system. Production headers 12, 14, and 16 are connected to and in fluid communication with subsea flowlines. FIG. 3 depicts a template manifold/system having three production headers 12, 14, and 16; however, the present invention is applicable to any template manifold/system having two or more flowlines and production headers. The subsea flowlines direct hydrocarbon production from production headers 12, 14, and 16 to a surface facility. As initially installed on a subsea template/manifold system, assembly 10 has pigging valves 32, 34, and 36 that are attached to production header connections 22, 24, and 26, respectively. Pigging valves 32, 34, and 36 are capable of allowing a pig to pass when the valves are in an open position.

Pigging valves 32 and 34 are connected by joint sections 42 and 44 to curved piping section 50. Curved piping section 50, which completes a flow path between production headers 12 and 14, is bent at a radius sufficient to permit a pig to flow freely through section 50. Pigging valve 36 may be connected to both ends of section 50 by a T-section 48 through joint section 46.

Other configurations of flowlines, production headers and pigging valves are acceptable as would be apparent to one skilled in the art based on this disclosure. As few as two flowlines and production headers may be utilized in this invention. If the present invention is utilized with a system having only two flowlines, only a single pigging valve is necessary. The invention may also be utilized in systems having large numbers of flowlines and multiple connections.

Assembly 10 as shown in FIG. 3 allows cleaning or clearing of flowlines connected to production headers 12 and 14. During normally operation, pigging valves 32, 34, and 36 are in a closed position. To clean or clear flowlines, pigging valves 32 and 34 are opened and the production headers are also isolated from the wells. Preferably, pigging valves 32, 34, and 36 are capable of remote operation. The use of remotely operated pigging valve 32, 34, and 36 are well known to those skilled in the art.

To clear the flowlines, a pig can be launched from the surface through a flowline connected to production header 12. The pig travels down the flowline, into and through production header 12, and passes through open pigging valve 32. The pig is then directed by curved piping section 50 back through open pigging valve 34 to production header 14, and returned to the surface through a second flowline where it can be retrieved.

Assembly 10 is attached to a subsea template manifold by a mounting base 60. The mounting base 60 has a base 62 with an opening 64 and a mounting hub 66. Production headers 12, 14, and 16 extend through opening 64 in base 62 and into mounting hub 66 which is aligned with opening 64. Mounting hub 66 is hollow and extends vertically upward from base 62. The make up and method of manufacture of such production headers, mounting base, and mounting hub are well known to those skilled in the art.

Assembly base 54 is firmly secured to the top portion 56 of hub 66. A housing 52 can be attached to assembly base 54 for enclosing a portion of said pigging valve assembly 10 including pigging valves 32, 34, 36. Production header connections 22, 24, and 26 provide a connection to production headers 12, 14, and 16 through assembly base 54.

The key advantages of the present invention come into play when an additional well or wells are developed at a remote distance away from the first subsea template/manifold system. Existing flowlines can easily be extended by modifying the pigging valve assembly 10 to provide connection points for new portions of flowline. The modification to assembly 10 is achieved by first retrieving assembly 10 to the surface. At the surface, curved piping section 50 is removed from joint sections 42, 44, and 46. Preferably, the connection to joint sections 42, 44, and 46 is a flanged connection or another connection means that can be readily disconnected.

Figure 4:
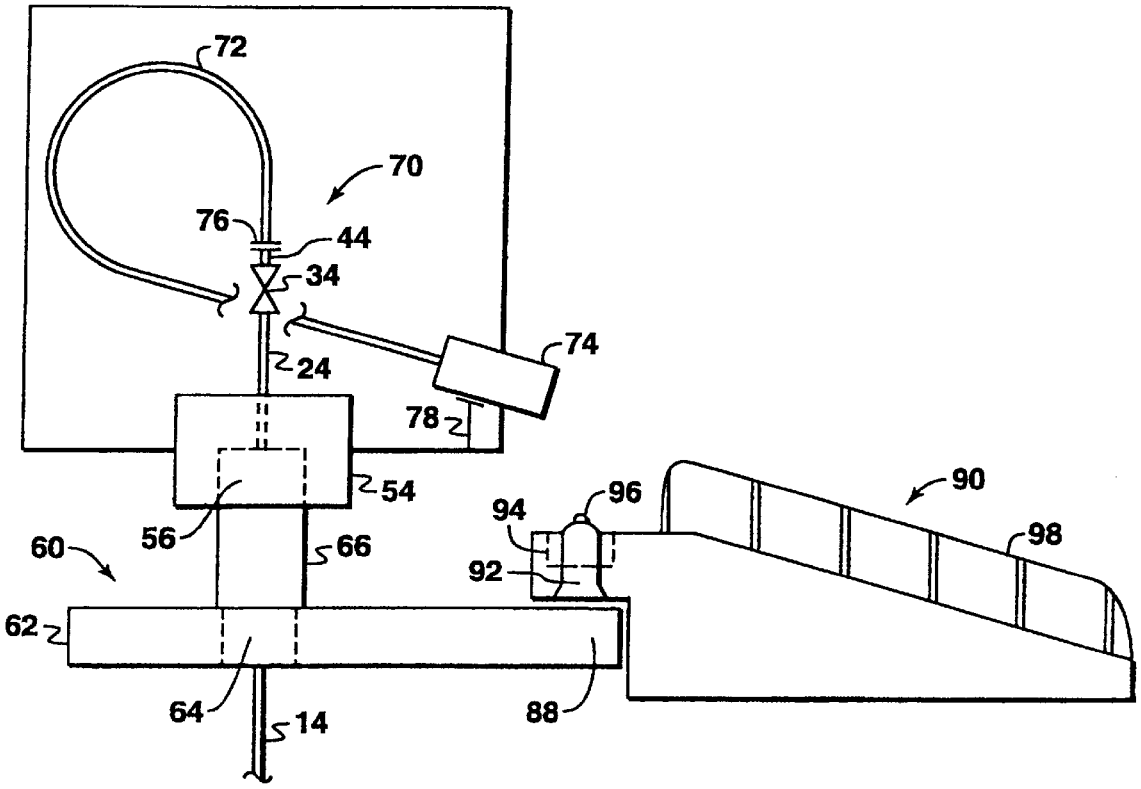
FIG. 4 is a side elevation of the assembly of FIG. 3 after modification to allow for flowline extension.

As shown in FIG. 4, the curved section 50 is replaced with at least one flowline connector adaptor 70 and a porch module 90. While only one flowline connection adaptor 70 is shown in FIG. 4, preferably, a flowline connector adaptor 70 is added to each joint sections 42 and 44 to allow extension of at least two flowlines. Porch module 90 provides support for new flowlines extending from flowline adaptor 70 and is equipped with guidance rails 98 providing guideways for the extended flowlines.

Flowline connector adaptor 70 has a bent pipe section 72, a flange connection 76 for attaching to joint section 44, and a flowline connector 74 for making connections with the extended flowline. It is important that the ability to clean and clear the flowlines remains intact after the extension; therefore, bent pipe section 72 should allow a pig to pass through. Optionally, a structural rest 78 may be added to support flowline connector 74.

Before flowline connector adaptor 70 is installed, porch module 90 is placed onto mounting base 60. Mounting base 60 has porch supports 92 which are required to structurally support porch module 90 once installed. Porch supports 92 are posts which fit into receptacles 94 of the porch module 90 for guidance and attachment. Guidelines may be attached to a guideline connection provision 96 on porch support 92 to help guide porch module 90 when it is lowered back down to the subsea template/manifold system. The outer edge 88 of base 62 may be reinforced to take the reaction load of porch module 90 when it is landed onto porch supports 92.

Once porch module 90 is in place, and flowline connector adaptor 70 has been installed on each joint section, the entire assembly 10 is lowered back onto the subsea template/manifold system. The flowlines coming into the subsea template manifold system can then be extended to the next site by attaching a new flowline to flowline connector 74.

The present invention provides a way to extend subsea flowlines from an initial subsea development at one site to a second site while minimizing the amount of equipment that must be pre-installed to provide such flexibility.

It will be appreciated by one skilled in the art based on this disclosure that variations and modifications may be made to the embodiments of the invention without departing from the spirit or scope of the invention as set forth in the accompanying claims. It is intended that all such variations and modifications fall within the scope of the present invention as claimed.

What is claimed is:

1. An apparatus for extending a subsea flowline from a template/manifold system at a first well site to a second well site, comprising:

a first and second flowline for transporting hydrocarbons from the first well site to a surface facility;

a first production header having (a) a first end in fluid communication with said first flowline, (b) a well connector, and (c) a second end;

a second production header having (a) a first end in fluid communication with said second flowline, (b) a well connector, and (c) a second end;

means for circulating fluids from the second end of said first production header into the second end of said second production header, said circulating means being removably attached to said second ends and adapted to pass a pigging device; and a valve in fluid communication with the second end of said first production header for isolating said first production header from said second production header, said valve being adapted to pass a pigging device;

wherein removal of said means for circulating fluids, from said second ends, provides a connection point for means for expanding said system for fluid distribution from the first well site to the second well site.

2. The apparatus of claim 1, wherein said circulating means comprises a detachable curved piping section.

3. The apparatus of claim 1, further comprising a second valve in fluid communication with the second end of said second production header for isolating said second production header, said second valve being capable of passing a pigging devise.

4. The apparatus of claim 1, wherein said valve is remotely operable.

5. The apparatus of claim 1, further comprising: a mounting base attached to the subsea template/manifold system and having a mounting hub; and an assembly base for securing said valve and said circulating means to said mounting hub.

6. The apparatus of claim 1, further comprising: a porch module for supporting said means for expanding.

7. The apparatus of claim 1, wherein said expanding means comprises a flowline connector adapter having a bent piping section adapted to pass a pigging device, and a flowline connector.

8. The apparatus of claim 1, further comprising at least one additional flowline for transporting hydrocarbons from the first well site to a surface facility, said additional flowline being in fluid communication with said means for circulating fluid.

9. The apparatus of claim 1, further comprising at least one additional production header being in fluid communication with said means for circulating fluid.

10. An apparatus for extending a subsea flowline from a template/manifold system at a first well site to a second well site, comprising:

a first and second flowline for transporting hydrocarbons from the first well site to a surface facility;

a first production header having (a) a first end in fluid communication with said first flowline, (b) a well connector, and (c) a second end;

a second production header having (a) a first end in fluid communication with said second flowline, (b) a well connector, and (c) a second end;

means for circulating fluids from the second end of said first production header into the second end of said second production header, said circulating means capable of (a) passing a pigging device, and (b) expanding said system for fluid distribution from the first well site to the second well site;

a first valve in fluid communication with the second end of said first production header for isolating said first production header, said valve being capable of passing a pigging device;

a second valve in fluid communication with the second end of said second production header for isolating said second production header, said second valve being capable of passing a pigging device;

a mounting base attached to the subsea template/manifold system and having a mounting hub; and an assembly base for securing said valves and said circulating means to said mounting hub.

11. The apparatus of claim 10, wherein said circulating means comprises a detachable curved piping section capable of being replaced by means for connecting a flowline extension between the first well site and the second well site.

12. The apparatus of claim 10, wherein said first and second valves are capable of being remotely operated.

13. The apparatus of claim 10, further comprising: a porch module for supporting a flowline extension.

14. The apparatus of claim 11, wherein said connecting means comprises a flowline connector adaptor having a bent piping section capable of passing a pigging device and a flowline connector.

15. The apparatus of claim 13, wherein said mounting base includes at least one post for attaching said porch module to said mounting base and said porch module includes at least one receptacles for receiving said posts.

16. The apparatus of claim 15, wherein said post includes a guideline connection means for lowering and guiding the apparatus onto the template/manifold system.

17. The apparatus of claim 10, further comprising at least one additional flowline for transporting hydrocarbons from the first well site to a surface facility, said additional flowline being in fluid communication with said means for circulating fluids.

18. The apparatus of claim 10, further comprising at least one additional production header being in fluid communication with said means for circulating fluids.

19. A method of extending a subsea flowline from a template/manifold system at a first well site to a second well site, comprising the steps of:

providing a template/manifold system having a first production header in fluid communication with a first flowline, a second production header in fluid communication with a second flowline, and a pigging assembly having at least one pigging valve and a detachable curved piping section for circulating fluids between the first and second production headers and capable of passing a pig;

removing the detachable curved piping section when extension of the flowlines is desired;

replacing the detachable curved piping section with at least one flowline connector adaptor for making a connection to a flowline extension; and adding a flowline extension to the flowline connector adaptor.

20. The method of claim 19, further comprising the steps of:

retrieving the pigging assembly from the subsea template/manifold system to a surface facility before the step of removing the detachable curved piping section; and reinstalling the assembly on the subsea template/manifold system at the first well site after replacing the detachable curved section with at least one flowline connector adaptor.

21. The method of claim 19, wherein the step of replacing the detachable curved piping section with a flowline connector adaptor further includes adding a porch module for supporting flowline extensions.

22. A method of extending a subsea flowline from a template/manifold system at a first well site to a second well site, comprising the steps of:

providing a template/manifold system having a first production header in fluid communication with a first flowline, a second production header in fluid communication with a second flowline, and a pigging assembly having at least one pigging valve and a detachable curved piping section for circulating fluids between the first and second production headers and capable of passing a pig;

retrieving the pigging assembly from the subsea template/manifold system to a surface facility;

removing the detachable curved piping section when extension of the flowlines is desired;

replacing the detachable curved piping section with at least one flowline connector adaptor for making a connection to a flowline extension; and reinstalling the assembly on the subsea template/manifold system at the first well site; and adding a flowline extension to the flowline connector adaptor.

23. An apparatus for extending a subsea flowline from a template/manifold system at a first well site to a second well site, comprising:

a first and second flowline for transporting hydrocarbons from the first well site to a surface facility;

a first production header having (a) a first end in fluid communication with said first flowline, (b) a well connector, and (c) a second end with a connection point;

a second production header having (a) a first end in fluid communication with said second flowline, (b) a well connector, and (c) a second end with a connection point;

a flow path allowing fluid communication between the second end of said first production header and the second end of said second production header, said flow path being removably attached to the connection points of the second ends of said production headers and being adapted to receive and pass a pigging device; and a valve in fluid communication with the second end of said first production header for isolating said first production header from said second production header, said valve adapted to pass a pigging device;

wherein upon removal of said flow path, the connection point of the second end of said first production header provides a point of attachment for a flowline extension between the first well site and the second well site.

24. The apparatus of claim 23, further comprising a second valve in fluid communication with the second end of said second production header for isolating said second production header, said second valve being adapted to pass a pigging device.

25. The apparatus of claim 24, wherein said second valve is remotely operable.

26. The apparatus of claim 23, wherein said valve is remotely operable.

27. The apparatus of claim 23, further comprising: a mounting base attached to the subsea template/manifold system, said base having a mounting hub; and an assembly base for securing said valve and said flow path to said mounting hub.

28. The apparatus of claim 23, further comprising: a porch module for supporting the flowline extension.

29. The apparatus of claim 23, wherein upon removal of said flow path, said connecting points provide for connection of a flowline connector adapter having a bent piping section adapted to receive and pass on a pigging device.

30. The apparatus of claim 23, further comprising at least one additional flowline for transporting hydrocarbons from the first well site to a surface facility.

31. The apparatus of claim 23, further comprising at least one additional production header adapted for fluid communication with said first or second production header.

32. An apparatus for extending a subsea flowline from a template/manifold system at a first well site to a second well site, comprising:

a first and second flowline for transporting hydrocarbons from the first well site to a surface facility;

a first production header having (a) a first end in fluid communication with said first flowline, (b) a well connector, and (c) a second end;

a second production header having (a) a first end in fluid communication with said second flowline, (b) a well connector, and (c) a second end;

means for circulating fluids from the second end of said first production header into the second end of said second production header; said circulating means capable of (a) passing a pigging device, and (b) expanding said system for fluid distribution from the first well site to the second well site;

a first valve in fluid communication with the second end of said first production header for isolating said first production header, said valve being capable of passing a pigging device; and a second valve in fluid communication with the second end of said second production header for isolating said second production header, said second valve being capable of passing a pigging device.

* * * * *